US005168835A

United States Patent [19]

Last

[11] Patent Number: 5,168,835

[45] Date of Patent: Dec. 8, 1992

[54] PULSATING COMBUSTION DEVICE

[75] Inventor: Anthony J. Last, Oakville, Canada

[73] Assignee: Serchen Corporation, Oakville, Canada

[21] Appl. No.: 749,714

[22] Filed: Aug. 26, 1991

[51] Int. Cl.[5] ..... F22B 31/00

[52] U.S. Cl. ..... 122/24; 55/15; 431/1

[58] Field of Search ..... 122/24; 431/1; 55/15

[56] References Cited

U.S. PATENT DOCUMENTS

| | | | |
|---|---|---|---|
| 1,993,748 | 3/1935 | Noack | 122/24 |
| 4,368,677 | 1/1983 | Kline | 431/1 X |
| 4,695,249 | 9/1987 | Gray | 431/1 X |
| 4,706,390 | 11/1987 | Kitchen | 431/1 X |
| 4,708,634 | 11/1987 | Verghe | 431/1 |
| 4,949,703 | 8/1990 | Ejiri et al. | 431/1 X |
| 4,960,078 | 10/1990 | Yokoyama et al. | 122/24 |
| 4,976,604 | 12/1990 | Nishino | 431/1 |
| 5,052,917 | 10/1991 | Saito et al. | 431/1 |

*Primary Examiner*—Edward G. Favors

*Attorney, Agent, or Firm*—Shoemaker and Mattare, Ltd.

[57] ABSTRACT

A water or fluid-cooled device consists of a plurality of exhaust tubes of uniform cross-section, similar to the tubes in a boiler. The tubes are connected to an elongate combustion chamber into which a combustible mixture is aspirated via one or a series a non-return valves. The fuel is initially ignited, and subsequently follows the conventional pattern for pulsating combustion. This pulsating combustion burner can be used as an instrument for making a series of shockwaves at a frequency of oscillation between 200 and 2000 Hz, and thus can be used in the conditioning of fine dust particles by agglomerating them. An alternate use is that of a burner for a boiler or a space heater, where suitable action is taken to silence the exhaust noise, and where the scrubbing action of the generated shockwaves inside the exhaust tubes improves the heat transfer to the surrounding medium by minimizing the laminar surface film or "stagnant layer" inside and outside the exhaust tubes.

5 Claims, 3 Drawing Sheets

PULSATING COMBUSTION DEVICE

This invention relates to the principle of pulsating combustion and is specifically related to the use of high frequencies and a split exhaust system, whereby the exhaust system is spread over a wider area than in the conventional single tube linear pulse combustor. When used as a burner these tubes have a large surface area and, due to the sweeping action of the shock waves, a better heat transfer can be obtained than is possible in a standard fire tube boiler system. When used as a generator of vibratory shock waves this device is of use to match these shock waves into a large exhaust duct through which the dust is flowing, thereby coagulating the dust to enhance its removal.

BACKGROUND OF THIS INVENTION

Linear pulsating combustion devices have been known for many years. These units have been tubular in shape and have been used for propulsion, the V-1 rocket of World War II being an infamous example. They have been used also for heating purposes. The LENNOX TM domestic burner using natural gas is a typically North American example. All these units have, in common, a single exhaust tube, the length of which determines the frequency of operation. The LENNOX TM burner for instance has a long exhaust pipe bent like a trombone which has a frequency of about 50 Hz. This frequency has a long wavelength and therefore the noise is difficult to suppress in a domestic environment. If that unit were scaled down in length so that the frequency of operation became higher, then the entire unit would be too small to operate effectively as a domestic burner.

GENERAL DESCRIPTION OF THE INVENTION

The unit that is the subject of this invention is comparatively short in length but has an elongated combustion chamber and multiple exhaust tubes. This configuration enables the frequency to be kept high while maintaining the fuel input at an acceptable level.

More particularly, this invention provides in combination:

a container for a fluid to be heated, and in the container;

at least one pulsating combustion unit, said at least one unit comprising:

a) means defining a combustion chamber, said means including a substantially flat base wall of elongate configuration, the base wall having a peripheral edge, and a side wall adjoining said base wall at said peripheral edge, the combustion chamber being situated such that a major portion of its outer surface is in contact with fluid in said container;

b) a plurality of openings through said base wall, the openings being substantially uniformly distributed over the surface of said base wall;

c) a plurality of substantially straight, substantially parallel exhaust tubes connected to respective said openings and extending generally perpendicularly away from said base wall, whereby a section taken through the tubes at right-angles to their axes shows the tubes to be distributed in an elongate pattern, thus facilitating access of surrounding fluid to all tubes, each exhaust tube being of uniform cross-section, the tubes being of a material and wall thickness which allows heat energy within said tubes to be rapidly transferred to fluid outside the tubes, the tubes being situated such that substantially all of the outer surface of each tube is in contact with fluid in said container;

d) inlet means for admitting a combustible fuel mixture to the combustion chamber;

e) ignition means for igniting the fuel mixture and initiating pulsating combustion; and f) collection means for removing exhaust gases from said exhaust tubes.

Further, this invention provides a method of heating a fluid in a container, comprising the steps:

A) providing at least one pulsating combustion unit, said at least one unit comprising:

a) means defining a combustion chamber, said means including a substantially flat base wall of elongate configuration, the base wall having a peripheral edge, and a side wall adjoining said base wall at said peripheral edge;

b) a plurality of openings through said base wall, the openings being substantially uniformly distributed over the surface of said base wall;

c) a plurality of substantially straight, substantially parallel exhaust tubes connected to respective said openings and extending generally perpendicularly away from said base wall, each exhaust tube being of uniform cross-section, the tubes being of a material and wall thickness which allows heat energy within said tubes to be rapidly transferred to a fluid outside the tubes;

B) placing the unit within the container such that substantially the entirety of the external surfaces of the tubes and a major portion of the outer surface of the combustion chamber are in contact with the fluid;

C) admitting a combustible fuel mixture to the combustion chamber and igniting the mixture to initiate pulsating combustion and eject hot gases through the exhaust tubes, whereby agitation of the hot gases in the exhaust tubes due to the pulsating shock waves produced by the pulsating combustion enhances heat transfer to and through the exhaust tube walls and into the fluid.

Finally, this invention provides a method of enhancing the collection of dust or aerosol from gas flowing through an exhaust duct, comprising the steps:

a) providing at least one pulsating combustion unit, said at least one unit including a plurality of exhaust tubes of uniform cross-section; an elongate combustion chamber communicating with said exhaust tubes; inlet means for admitting a combustible fuel mixture to the combustion chamber; and ignition means for igniting the fuel mixture;

b) placing the unit within the exhaust duct; and c) admitting a combustible fuel mixture to the combustion chamber and igniting the mixture to initiate pulsating combustion and eject hot gases through the exhaust tubes, whereby agitation of the hot gases in the exhaust tubes due to the pulsating shock waves produced by the pulsating combustion is transferred to the gas in the exhaust duct, thereby coagulating the dust or aerosol to improve collection.

GENERAL DESCRIPTION OF THE DRAWINGS

Two embodiments of this invention are illustrated in the accompanying drawings, in which like numerals denote like parts throughout the several views, and in which.

Figure 1:
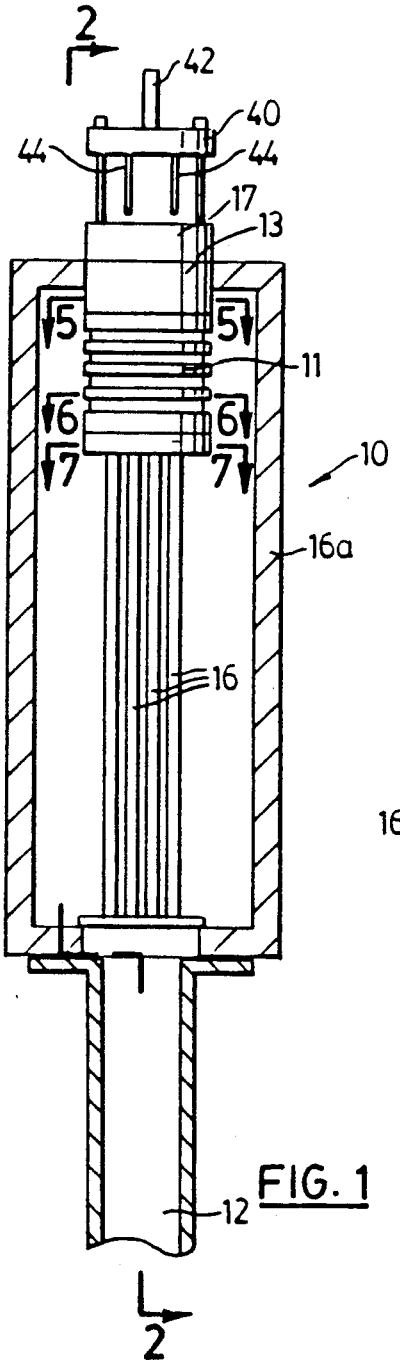
FIG. 1 is a vertical sectional view of a pulsating combustion unit constructed in accordance with this invention, taken along the line 1—1 in FIG. 2.
Figure 2:
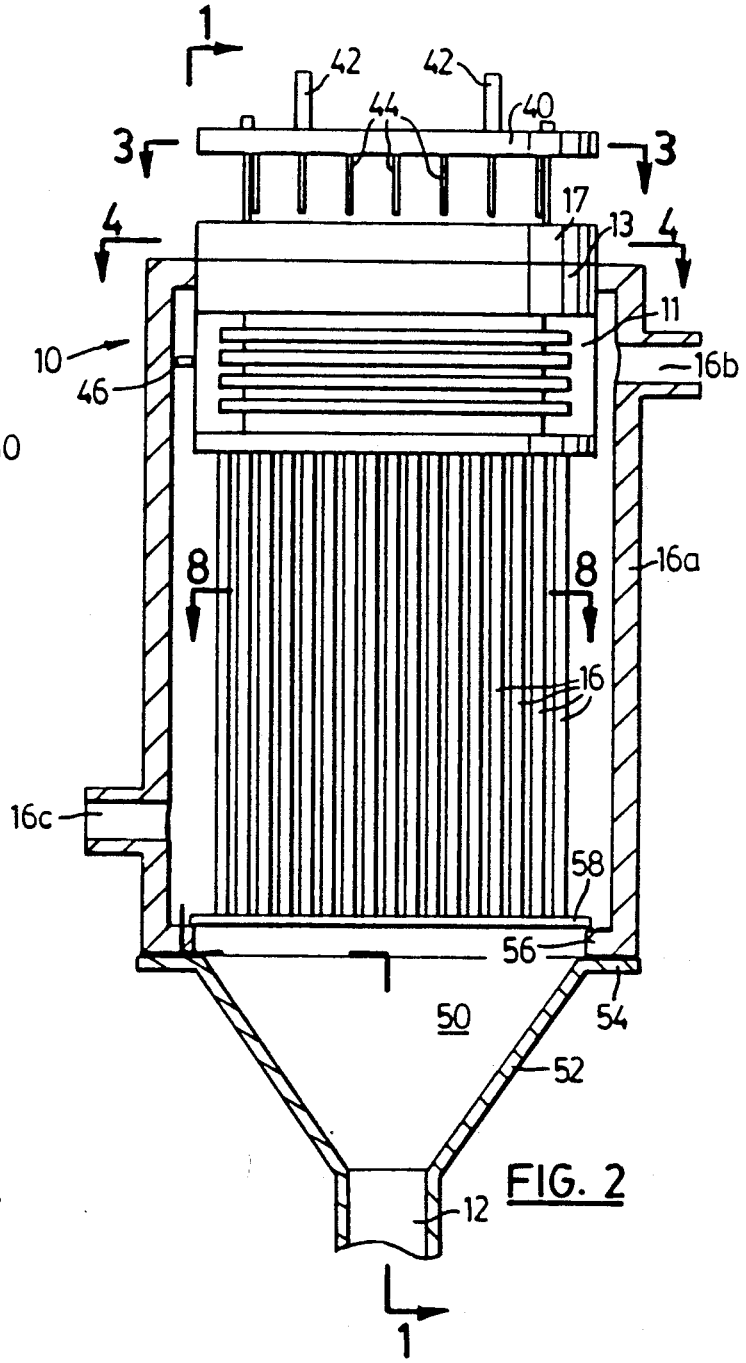
FIG. 2 is a vertical sectional view of the unit shown in FIG. 1, taken along the line 2—2 in FIG. 1.
Figure 10:
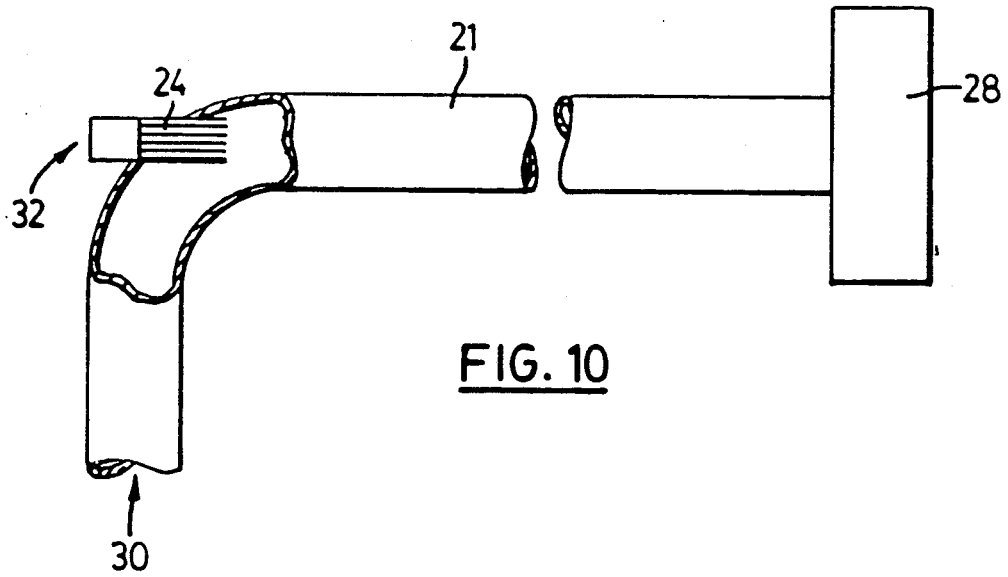
Figure 11:
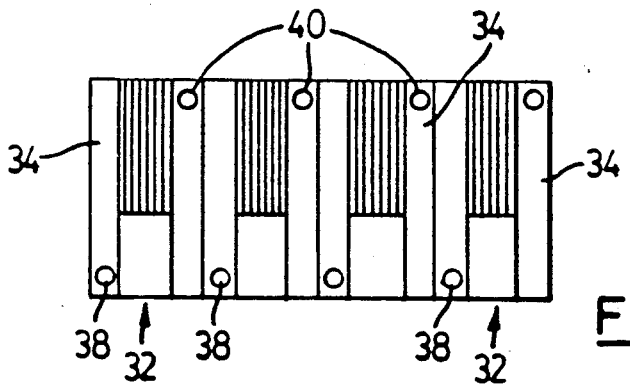
Figure 12:
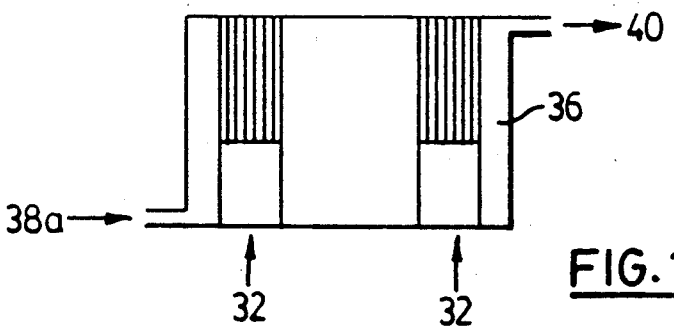

FIGS. 3, 4, 5, 6, 7, 8 and 9 are horizontal sectional views taken at the lines 3—3, 4—4, 5—5, 6—6, 7—7, 8—8, and 9—9 in FIGS. 1 and 2;

FIG. 10 is a schematic plan view of a dust conditioning system utilizing the unit of this invention;

FIG. 11 is a schematic vertical sectional view of one embodiment of this invention showing the use of a plurality of units with separate containers; and FIG. 12 is a schematic vertical sectional view similar to FIG. 11, but showing the use of a plurality of units within a common container.

DETAILED DESCRIPTION OF THE DRAWINGS

Attention is now directed to FIGS. 1 and 2, which show respectively the side and front elevations of a pulsating combustion unit 10 constructed in accordance with this invention. The combustion unit 10 includes a plurality of straight exhaust tubes 16 with substantially uniform cross-section throughout their length. The tubes may typically be circular, square or elliptical in cross-section. The tubes 16 are preferably made from a material and have a thickness such as to allow rapid transfer of heat energy from the interior of each tube 16 to a fluid surrounding the tube. Suitable materials for the tubes 16 would be aluminum, copper and stainless steel.

The fluid in which the tubes 16 are immersed may be either a liquid or a gas. In FIGS. 1 and 2 there is schematically drawn a container 16*a* having a fluid outlet 16*b* and a fluid inlet 16*c*. A common combustion chamber 11 receives a combustible mixture through suitable transfer ports in a mixing chamber 13, which in turn receives a combustible mixture from a chamber 17 through mechanical valves 17*a* (see FIG. 4). The valves 17*a* allow the combustible mixture to enter the combustion chamber 11 (after traversing chambers 13), but substantially prevent the products of combustion from leaving the combustion chamber 11 other than through the exhaust tubes 16 and subsequently into exhaust outlet 12.

It will be noted that the outlet 12 is coaxial with and communicates with a conical chamber 50 defined by a frusto-conical wall 52 having an annular, outwardly projecting flange 54. The flange 54 lies against and is secured to an inwardly directed flange 56 at the bottom of the substantially cylindrical container 16*a*. These two flanges 54 and 56 may be secured together by any suitable means, for example bolts or other fasteners. A gasket may be provided between the flanges.

The tubes 16 extend downwardly in a parallel manner, and the bottom ends thereof are welded to an oval flange 58 which rests against the inner upper corner of the flange 56 of the container 16*a*. Pressure between the plate 58 and the flange 56 prevents communication between the conical chamber 50 and the space within the container 16*a*, thus keeping the water separated from the combustion gases.

Figure 3:
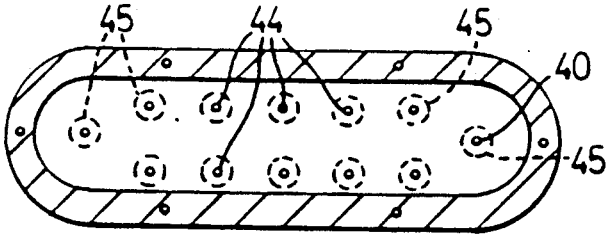

At the top of FIGS. 1 and 2, the numeral 40 designates a fuel plenum which receives fuel through two inlet pipes 42, and which distributes the fuel to a plurality of fuel needles 44 that are spaced above corresponding, over-sized openings at the top of the chamber 17, shown in broken lines at 45 in FIG. 3. The needles 44 produce jets of gaseous fuel which entrain air as they enter the chamber 17.

Figure 4:
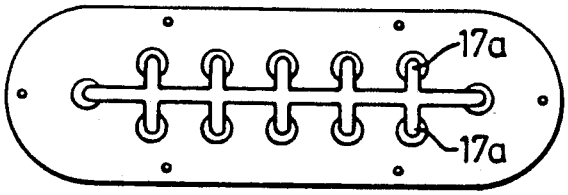

Although FIG. 4 shows mechanical valves 17*a*, it will be understood that aerodynamic valves could be used in place of the mechanical valves.

Also included is a means for igniting the fuel mixture initially in the combustion chamber 11, this means being schematically illustrated as a spark plug 46.

The embodiment illustrated in FIGS. 1 and 2 includes sixty-four exhaust tubes 16, however it will be understood that the actual number of tubes could vary in accordance with various design constraints.

FIGS. 3 through 9 are cross-sectional drawings taken through the section lines 3—3 through 9—9, respectively, in FIGS. 1 and 2.

In FIG. 3 there is shown the plenum 40, along with the needles 44.

FIG. 4 shows the mechanical valves 17*a* and is taken through the location where the fuel and the entrained air are initially mixed.

Figure 5:
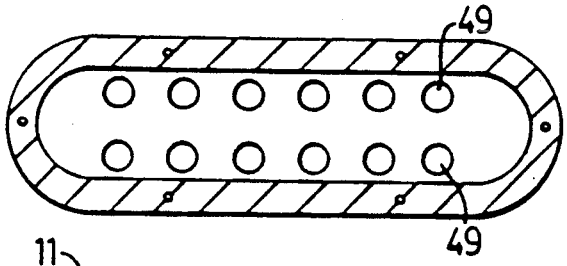

FIG. 5 shows the mixing chamber transfer ports 49.

Figure 6:
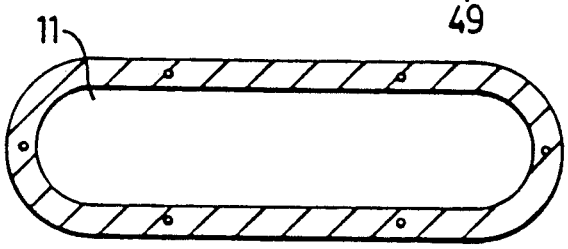

FIG. 6 is taken through the elongate, oval combustion chamber 11.

Figure 7:
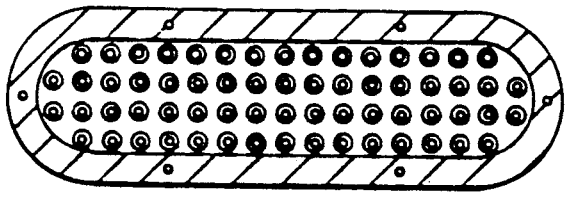

FIG. 7 is taken at the location of transition from the combustion chamber 11 to the tubes 16

Figure 8:
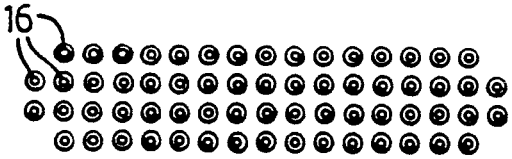

FIG. 8 shows the exhaust tubes 16.

Figure 9:
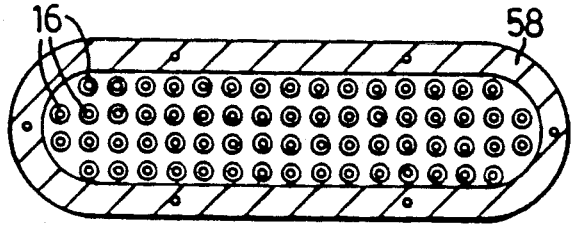

FIG. 9 is taken through the plate stabilizing the lower ends of the exhaust tubes 16.

FIG. 10 is a schematic drawing showning a dust conditioning duct 21 through which dust-laden air or gas 30 flows. At a bend in the duct 21, one or a plurality of pulsating combustion units 24 are placed. Fuel is fed at 32 to the unit or units. The shockwaves produced by the pulsating combustion units condition the dust by substantially agglomerating the fine dust particles so that they can be dealt with more efficiently in a collector 28, which may be a venturi scrubber, an electrostatic collector, or a similar device. Energy is saved in view of the fact that larger dust particles take substantially less energy to collect than do small particles.

FIGS. 11 and 12 indicate the use of the pulsating combustion unit as a boiler or heater of a fluid in two different configurations. FIG. 11 shows a plurality of containers 34 each containing a pulsating combustion unit, and each unit containing a means for supplying fuel 32, whether by mechanical or aerodynamic valving. Further, each separate container has a separate fluid inlet 38 and a separate fluid outlet 40. FIG. 12 is substantially the same as FIG. 11, except for the single container 36 which has a single inlet 38*a*, a single outlet 40*a*, and a plurality of pulsating combustion units incorporated into it.

Test Results from a Device Using Natural Gas and Water Cooling

A test unit designed substantially as seen in FIGS. 1 and 2 was assembled for test purposes. This unit was an effective hot water heater and used natural gas as fuel and water as the coolant. The overall size of the burner was 16.5 inches long, 7.5 inches broad and 2.5 inches wide not including the water jacket. This size was nominally rated at 50,000 B.T.U/Hr. with 7 inches water column gas pressure.

Preliminary tests with gas pressure at 6 psig. and a gas flow at a nominal 80 Cfh. using a teflon laminated mesh flap valve, 0.008 inches thickness, gave the following results:

Over a typical 100 seconds of operation the temperature of the cooling water, both incoming and outgoing, was taken every five seconds by means of temperature sensors, and was fed into a computer. The average energy in the water, flowing at 2.0 U.S. gpm., was calculated to be 76,896 B.T.u./Hr. representing an approximate efficiency of 96%. The burner was run for about one hour and the results were substantially the same throughout that time. The exhaust gas temperature at the point of exit from the exhaust tubes 12 varied between 170° and 180° F.

While several embodiments of this invention have been illustrated in the accompanying drawings and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. In combination:

a container for a fluid to be heated, and in the container:

at least one pulsating combustion unit, said at least one unit comprising:

a) means defining a combustion chamber, said means including a substantially flat base wall of elongate configuration, the base wall having a peripheral edge, and a side wall adjoining said base wall at said peripheral edge, the combustion chamber being situated such that a major portion of its outer surface is in contact with fluid in said container;

b) a plurality of openings through said base wall, the openings being substantially uniformly distributed over the surface of said base wall;

c) a plurality of substantially straight, substantially parallel exhaust tubes connected to respective said openings and extending generally perpendicularly away from said base wall, whereby a section taken through the tubes at right-angles to their axes shows the tubes to be distributed in an elongate pattern, thus facilitating access of surrounding fluid to the exterior of all tubes, each exhaust tube being of uniform cross-section, the tubes being of a material and wall thickness which allows heat energy within said tubes to be rapidly transferred to fluid outside the tubes, the tubes being situated such that substantially all of the outer surface of each tube is in contact with fluid in said container;

d) inlet means for admitting a combustible fuel mixture to the combustion chamber;

e) ignition means for igniting the fuel mixture and initiating pulsating combustion; and f) collection means for removing exhaust gases from said exhaust tubes.

2. The combination claimed in claim 1, in which the openings through the base wall are disposed substantially in a rectangular grid pattern, whereby the exhaust tubes are likewise disposed in a rectangular grid pattern.

3. The combination claimed in claim 1, in which the peripheral edge of said base wall includes two rectilinear, substantially parallel and opposed side portions, and two end portions joining extremities of the side portions.

4. A method of heating a fluid in a container, comprising the steps:

A) providing at least one pulsating combustion unit, said at least one unit comprising:

a) means defining a combustion chamber, said means including a substantially flat base wall of elongate configuration, the base wall having a peripheral edge, and a side wall adjoining said base wall at said peripheral edge;

b) a plurality of openings through said base wall, the openings being substantially uniformly distributed over the surface of said base wall;

c) a plurality of substantially straight, substantially parallel exhaust tubes connected to respective said openings and extending generally perpendicularly away from said base wall, each exhaust tube being of uniform cross-section, the tubes being of a material and wall thickness which allows heat energy within said tubes to be rapidly transferred to a fluid outside the tubes;

B) placing the unit within the container such that substantially the entirety of the external surfaces of the tubes and a major portion of the outer surface of the combustion chamber are in contact with the fluid;

C) admitting a combustible fluid mixture to the combustion chamber and igniting the mixture to initiate pulsating combustion and eject hot gases through the exhaust tubes, whereby agitation of the hot gases through the exhaust tubes due to the pulsating shock waves produced by the pulsating combustion enhances heat transfer to and through the exhaust tubes walls and into the fluid.

5. A method of enhancing the collection of dust or aerosol from gas flowing through an exhaust duct, comprising the steps:

a) providing at least one pulsating combustion unit, said at least one unit including a plurality of exhaust tubes of uniform cross-section; an elongate combustion chamber communicating with said exhaust tubes; inlet means for admitting a combustible fuel mixture to the combustion chamber; and ignition means for igniting the fuel mixture;

b) placing the unit within the exhaust duct; and c) admitting a combustible fuel mixture to the combustion chamber and igniting the mixture to initiate pulsating combustion and eject hot gases through the exhaust tubes, whereby agitation of the hot gases in the exhaust tubes due to the pulsating shock waves produced by the pulsating combustion is transferred to the gas in the exhaust duct, thereby coagulating the dust or aerosol to improve collection.

* * * * *